United States Patent [19]

Long et al.

[11] Patent Number: 5,070,762

[45] Date of Patent: Dec. 10, 1991

[54] DUAL AMMUNITION TRANSFER MECHANISM

[76] Inventors: Donald A. Long, 5362 Ayrhire Dr., San Jose, Calif. 95118; Tony T. Chiu, 15907 Rochin Ct., Los Gatos, Calif. 95032

[21] Appl. No.: 562,986

[22] Filed: Aug. 3, 1990

[51] Int. Cl.[5] ..... F41A 9/37

[52] U.S. Cl. ..... 89/33.04; 89/33.01; 89/33.14

[58] Field of Search ..... 89/33.01, 33.04, 33.1, 89/33.14, 33.16

[56] References Cited

U.S. PATENT DOCUMENTS

| | | | |
|---|---|---|---|
| 3,763,741 | 10/1973 | Rieke | 89/33.14 |
| 4,424,735 | 1/1984 | Bacon et al. | 89/34 |
| 4,492,144 | 1/1985 | Dix | 89/33.17 |

*Primary Examiner*—Stephen C. Bentley

*Attorney, Agent, or Firm*—A. J. Moore; R. C. Kamp; R. B. Megley

[57] ABSTRACT

A dual ammunition transfer mechanism includes a pair of ammunition round feed conveyors for selectively conveying the same size but different types of rounds toward a pivotal round selector finger. One conveyor is stopped while the other conveyor is driven causing the rounds therein to move past a round deflector finger which guides the rounds between driven star wheels and a Z-shaped feeder. A round kicker drives rounds one at a time into a slot in a disc rotating at high speeds and having camming surfaces therein which cooperates with a round lifting finger which momentarily enters the slot and stops the round while the disc continues to rotate while camming the round out of the slot at a rate of up the 400 rounds per minute.

28 Claims, 16 Drawing Sheets

VEHICLE BODY
73
V
72
30
AMMUNITION HOPPERS
32
34
36
80
76
78
R
R'
TRANSFER CONVEYORS
G
A
50
46
54
53
90
68
R,R'
48
52
GUN TRANSFER UNIT
ACCUMULATOR MAGAZINE
64
66
58
56
70
80
84
73

FIG_3
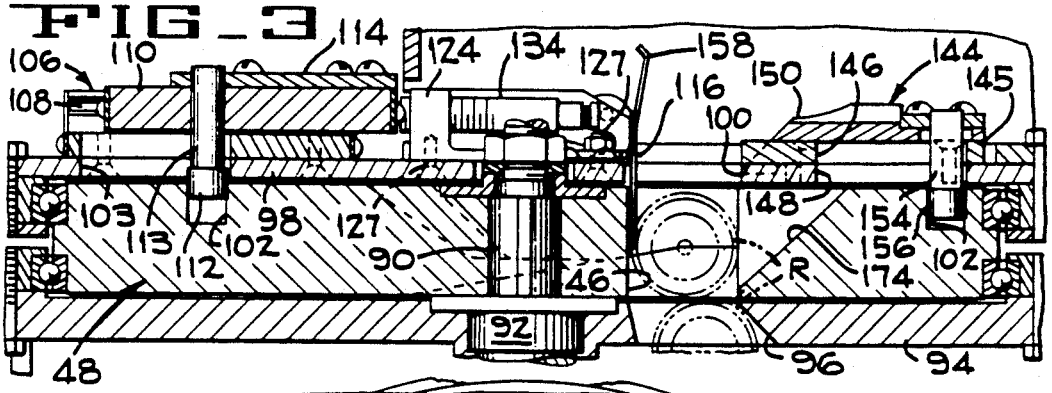
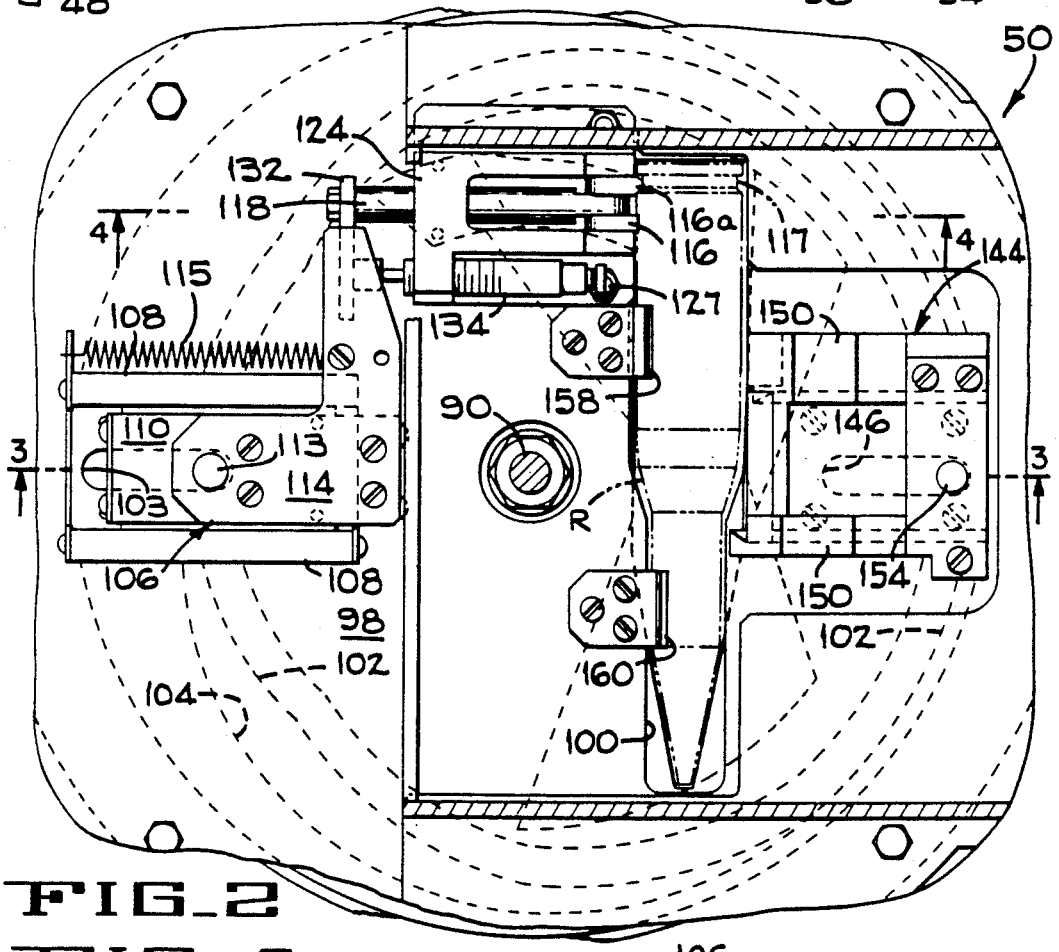
FIG_2
FIG_4
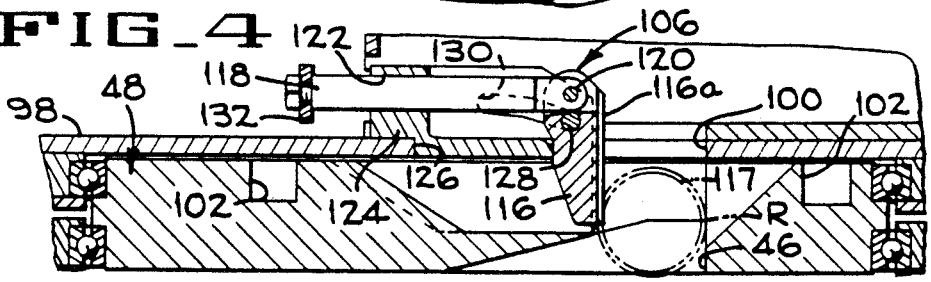

234
232
34
243
246
240
302'
318
308
310
278
322
316
38
230
212
204
206'
216'
244
208
206
216
R
42'
42
202
188
190
198
196
182
192
94
45
45'
44
53
90
52

DUAL AMMUNITION TRANSFER MECHANISM

BACKGROUND OF THE INVENTION

1. Field of the Invention

The present invention relates to ammunition transfer mechanisms and more particularly relates to a dual transfer mechanism which receives the same or different types of ammunition of the same size, and loads the ammunition into a contoured cam slot in a rotating transfer disc for discharge from the other side of the slot into a conveying system to a gun that is rotatable about the axis of the transfer disc.

2. Description of the Prior Art

Bacon et al U.S. Pat. No. 4,424,735 discloses a two-layer liner linkless ammunition magazine for use in helicopters for supplying ammunition to a gun and returning the empty shells to a chain driving at least two tiers of ammunition through storage magazines without partitions between the two tiers. Upper and lower groups of shells are conveyed through the magazine while supported on driven endless chains.

The patent to Dix U.S. Pat. No. 4,492,144 discloses a system for transporting linkless ammunition and returning the empty shells for collection. The gun and a portion of the mechanism for transporting ammunition are mounted for rotation in azimuth and the gun is rotatable about a generally horizontal axis.

SUMMARY OF THE INVENTION

The present invention relates to ammunition loaders and more specifically to a continuous feed through slip ring ammunition loader The ammunition is in the form of cartridges and projectiles, hereinafter referred to as rounds, that are fed into a contoured round receiving opening in a rotating cam disc by a round kicker, which disc rotates at a constant velocity thereby moving each round, in turn, into the round receiving opening in the disc and into position to be engaged by a pick-off paw attached to a pick-off plate that is rotatable with a gun turret. The pick-off paw lifts one end of the round up and through the transfer disc into position to be transferred into either a feed system of a gun or into an accumulator magazine in the feed system. The upper portion of the ammunition loader, the gun, the accumulator magazine, and conventional gun feed conveyors are all supported for rotation about an azimuth axis while the rounds are being conveyed.

BRIEF DESCRIPTION OF THE DRAWINGS

FIG. 2 is an enlarged plane of an ammunition or round transfer mechanism and components associated therewith.

FIG. 3 is a section taken along lines 3—3 of FIG. 2.

FIG. 4 is a section taken along lines 4—4 of FIG. 2.

DESCRIPTION OF THE PREFERRED EMBODIMENT

Prior to describing the several components of the dual ammunition transfer system 30 (FIG. 1) of the present invention, it will be apparent that many of the components are closely spaced from each other thus requiring a plurality of drawings to adequately illustrate the components.

In general, the ammunition transfer system 30 includes an ammunition hopper 32 which preferably stores two different types of ammunition such as armor piercing, high explosive, tracers and other ammunitions rounds therein. The ammunition will hereinafter be referred to as rounds R and R'. It will be understood that larger or smaller rounds than that specified may be transferred with the dual ammunition loader of the present invention by altering the size of the loader.

Figure 1:
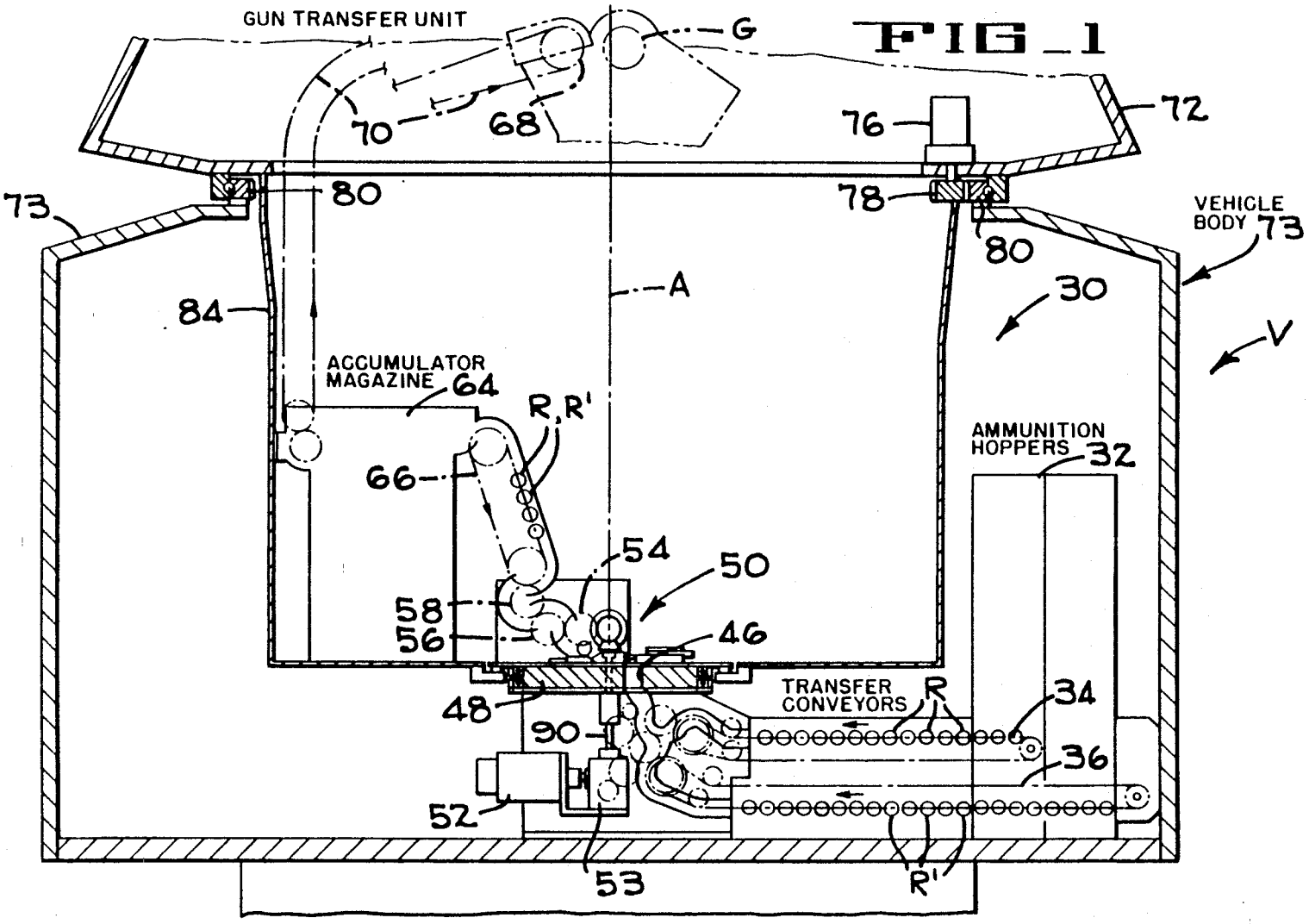
FIG. 1 is a diagrammatic elevation with parts shown in central section illustrating the components of the dual ammunition transfer mechanism of the present invention mounted within the hull of a military vehicle.
Figure 6:
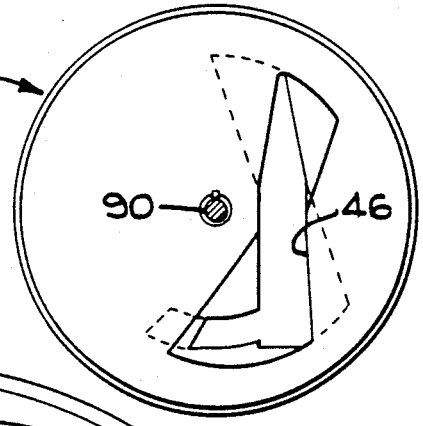
FIG. 6 is a bottom view of the circular round transfer disc at a reduced scale illustrating the disc inverted from its round receiving position.
Figure 19:
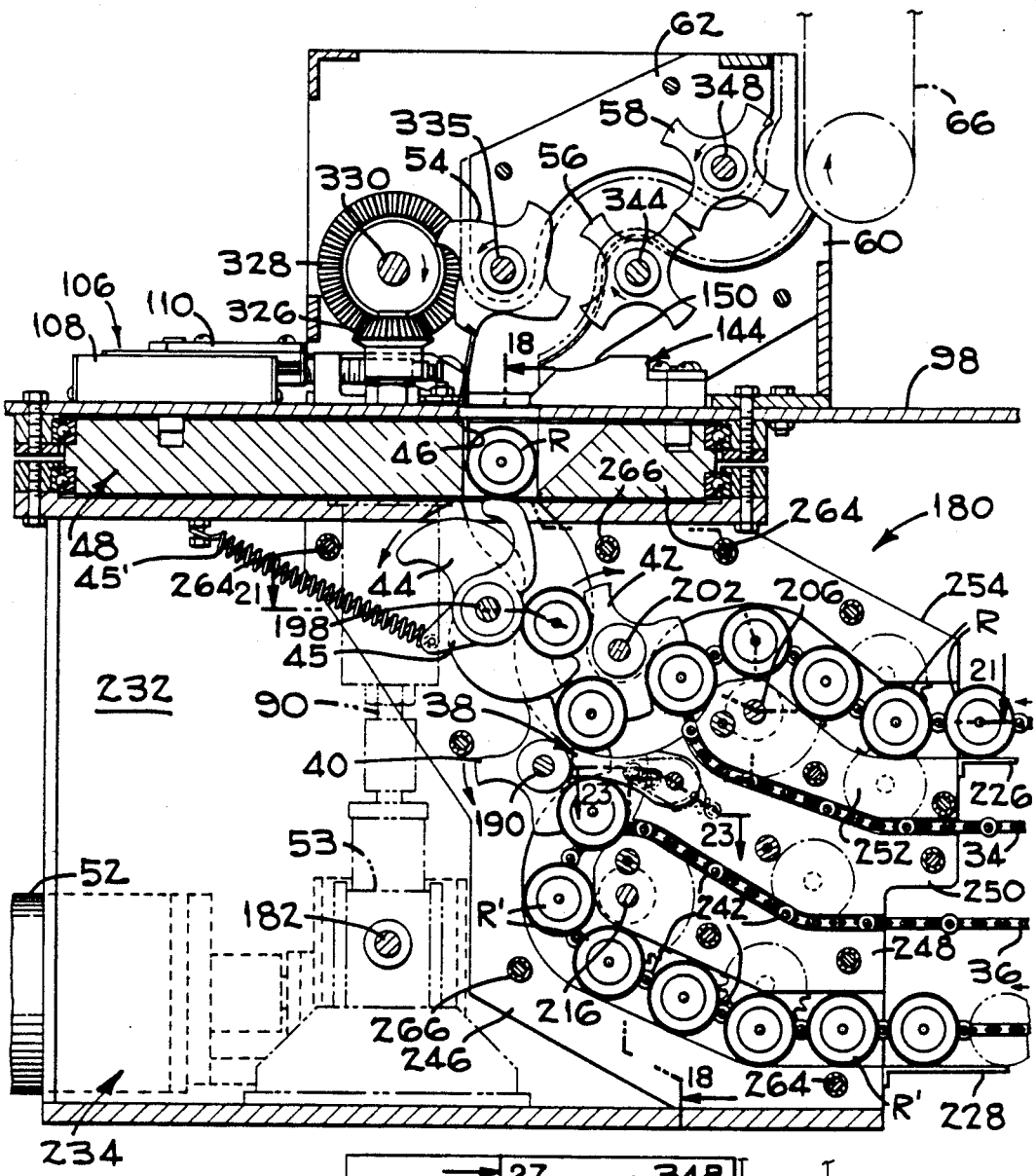
FIG. 19 is a vertical section taken along lines 19—19 of FIG. 18 illustrating the path of movement of two rows of rounds and certain guide mechanisms for moving the rounds into and through the circular transfer disc, with certain other components above the disc being rotated approximately 180° relative to FIG. 17.
Figure 20:
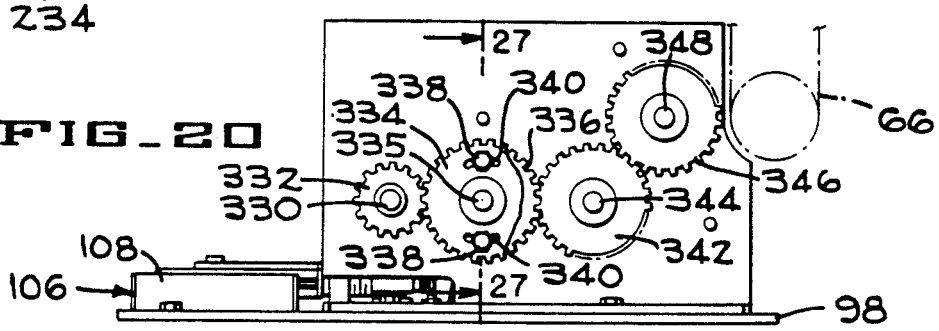
FIG. 20 is a side view illustrating drive gears for driving the round engaging star wheels that are located above the transfer disc as shown in FIG. 19.

The desired rounds are stored in the ammunition hopper 32 and are fed into an upper conveyor 34 and a lower conveyor 36 (FIGS. 1 and 19). Round selector finger assembly 38 (FIG. 19) determine which conveyor will advance its rounds into a gun G. Star wheels 40,42 and Z-shaped feeder wheels 44; and a spring actuated round kicker 45 is then actuated by a spring 45' which feeds each round R or R' into a slot 46 in a transfer disc 48, which disc is driven by a motor drive system 52 which includes a gear box 53. Each round is moved through the slot 46 in the transfer disc, by means to be described in more detail hereinafter, in response to being rotated 360° about an azimuth axis A.

After moving through the slot 46, the rounds are advanced by driven star wheels 54, 56, 58 along guide tracks 60 and 62 into an accumulator magazine 64 (FIG. 1) by a flexible conveyor 66 and are thereafter conveyed into a gun transfer unit 68 (FIG. 1) of a conventional gun G, such as a chain gun, by a conventional flexible conveying system 70.

The gun G is illustrated out of its normal position but is preferably mounted on a turret 72 that is supported on the body 73 of a vehicle V for rotation or pivotal movement about the azimuth axis A by an azimuth drive motor 76 and a gear 78 which meshes with a stationary ring gear 80 that is supported on the vehicle body 73.

A rotatable turret basket 84 is secured to the turret 72 and rotates or pivots with the gun G as a unit.

The transfer disc 48 and associated transfer components are illustrated in greater detail in FIGS. 1, and 3–15A.

As best shown in FIGS. 1 and 3, the rotatable transfer disc 48 is keyed to a shaft 90 that is journaled in a large bearing 92 (FIG. 3) mounted to stationary non-rotatable bottom plate 94 having a tapered inlet opening 96 therein which conforms to the particular size and shape of the ammunition rounds R being handled. A rotatable upper plate 98 is similar to the bottom plate 94 and has an outlet opening 100 which rotates with the gun G and conforming to the shape of the rounds R being handled. As best shown in FIGS. 2–4, a round lifting cam groove 102 and a second cam groove 104 is formed in the upper surface of the transfer disc 48 for actuating mechanisms which lift the rounds R out of the transfer disc in response to rotation of the transfer disc 360°. Similarly, the cam groove 102 is formed in the upper surface of the transfer disc and assists in raising the rounds R out of the transfer disc 48 to a position above the upper plate 98 as illustrated in FIGS. 2–15A as will be described in more detail below.

As best shown in FIGS. 2–4 and 7–11, it will be noted that a round lifting mechanism 106 includes slide ways 108 (FIG. 2) which are rigidly secured to the upper rotatable plate 98 and receives a slider 110. A cam follower 112 is journaled on a pin 113 connected to the slider and is rotatably received in the upper portion of the groove 102 and in a slot 103, which upon rotation of the transfer disc 48 reciprocates the slider 110 between the positions illustrated in FIGS. 7–10.

As best shown in FIGS. 2–4 and 7–12 the L-shaped angle bracket 114 (FIG. 2) is connected to the slider 110 and is urged away from the shaft 90 by a spring 115. The round lifting mechanism 106 includes a forked ammunition lifter finger 116 (FIGS. 2 and 4) which is pivotally connected to a rod 118 by a pivot pin 120 (FIG. 4) and includes a V-shaped edge **116*a* which enters an ejection groove 117 (FIG. 14) in the round R which prevents the round from being moved axially. The rod 118 is slidably received in the cylindrical opening 122 (FIG. 4) in a bracket 124 that is rigidly secured to an opening 126 in the upper plate 98 by bolts 127, only two being shown in FIG. 3. A pin 128 in the forked lifting finger 116 is slidably received in curved slots 130 (only one being shown) which progressively cams the forked lifter fingers 116 between the positions illustrated in FIGS. 4 and 7–10 in response to the rod 118 being moved to the left (FIG. 7) by the cam track 102**.

As illustrated in FIG. 2, the rod 118 is rigidly secured to a vertical plate 132 which is secured to the bracket 114, and a shock absorber 134 is threaded into a hole (not shown) in the bracket 124.

Figure 10:
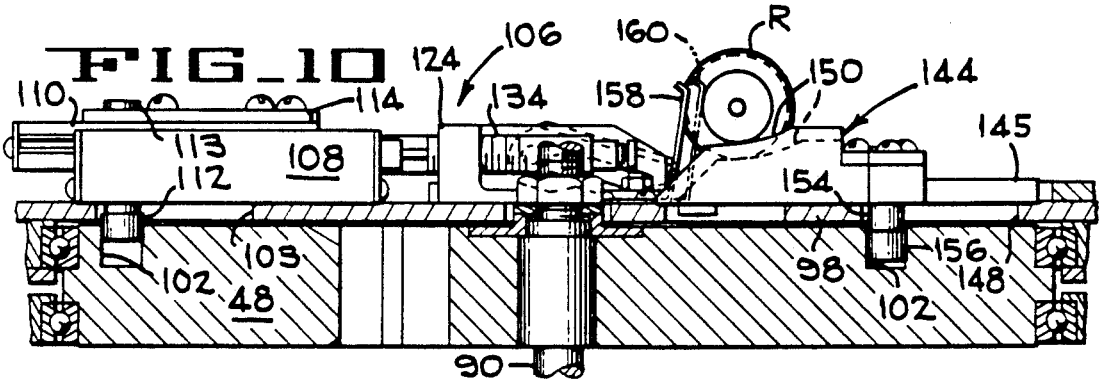
FIG. 10 is an operational view similar to FIG. 7 but illustrating the transfer disc rotated about 180° relative to FIG. 3.
Figure 11:
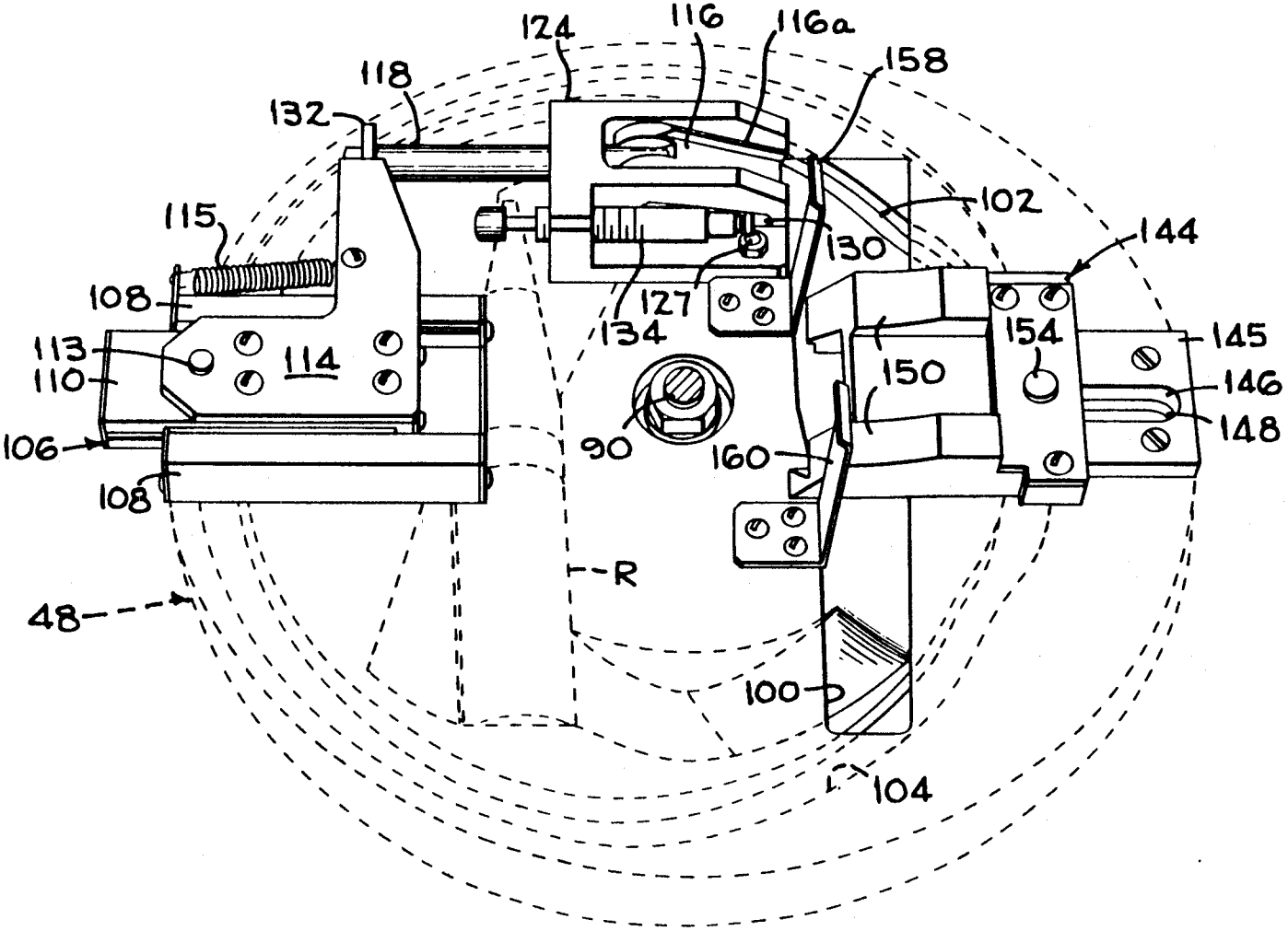
FIGS. 11, 12, 13 and 14 are operational views in perspective illustrating a round moving about 180° in a counterclockwise direction, and further illustrating components supported on a rotatable upper wall moving into different operative positions relative to an outlet opening.
Figure 12:
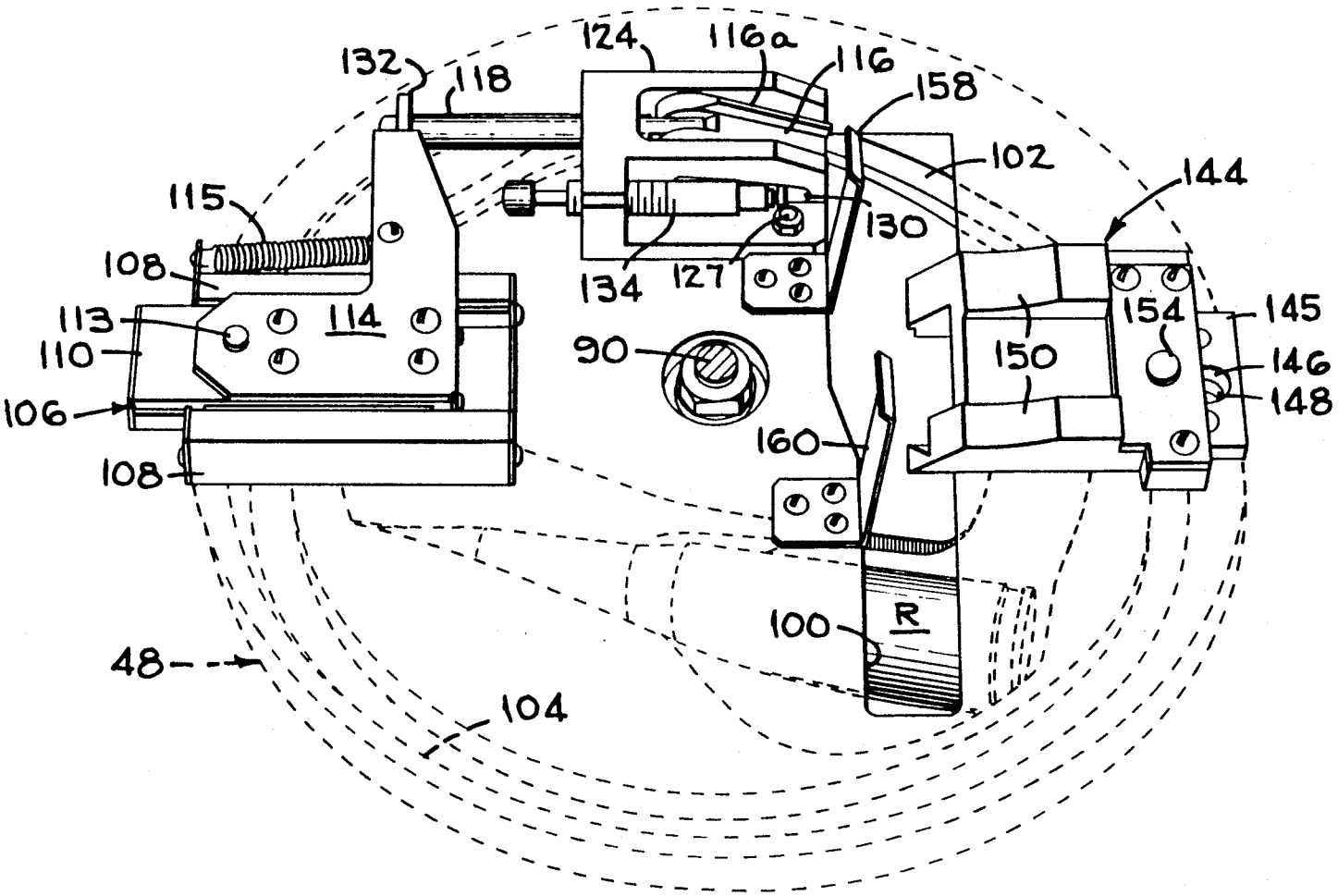

As best shown in FIGS. 2, 3 and 11, a round lifter 144 is movably mounted on the rotatable upper plate 98. The round lifter 144 includes a guide plate 145 bolted to the upper plate 98 and having aligned cam slots 146,148 therein and in the upper plate 98, respectively. The round lifter 144 includes tapered and curved round engaging lifting surfaces 150 and is slidably received by the guide plate 145 and includes a cam pin 154 which extends into the deeper cam slot 102 (FIG. 3) and rotatably receives a cam follower 156 (FIGS. 2–3 and 7–10) which reciprocates the round lifter 144 radially toward and away from the axis of rotation of the rotatable transfer disc 48 once for each revolution of the transfer disc 48. A pair of upstanding resilient round guides 158,160 cooperate with the round lifting mechanism 144 to maintain control of the rounds when moving upwardly and out of the transfer disc 48.

Figure 5:
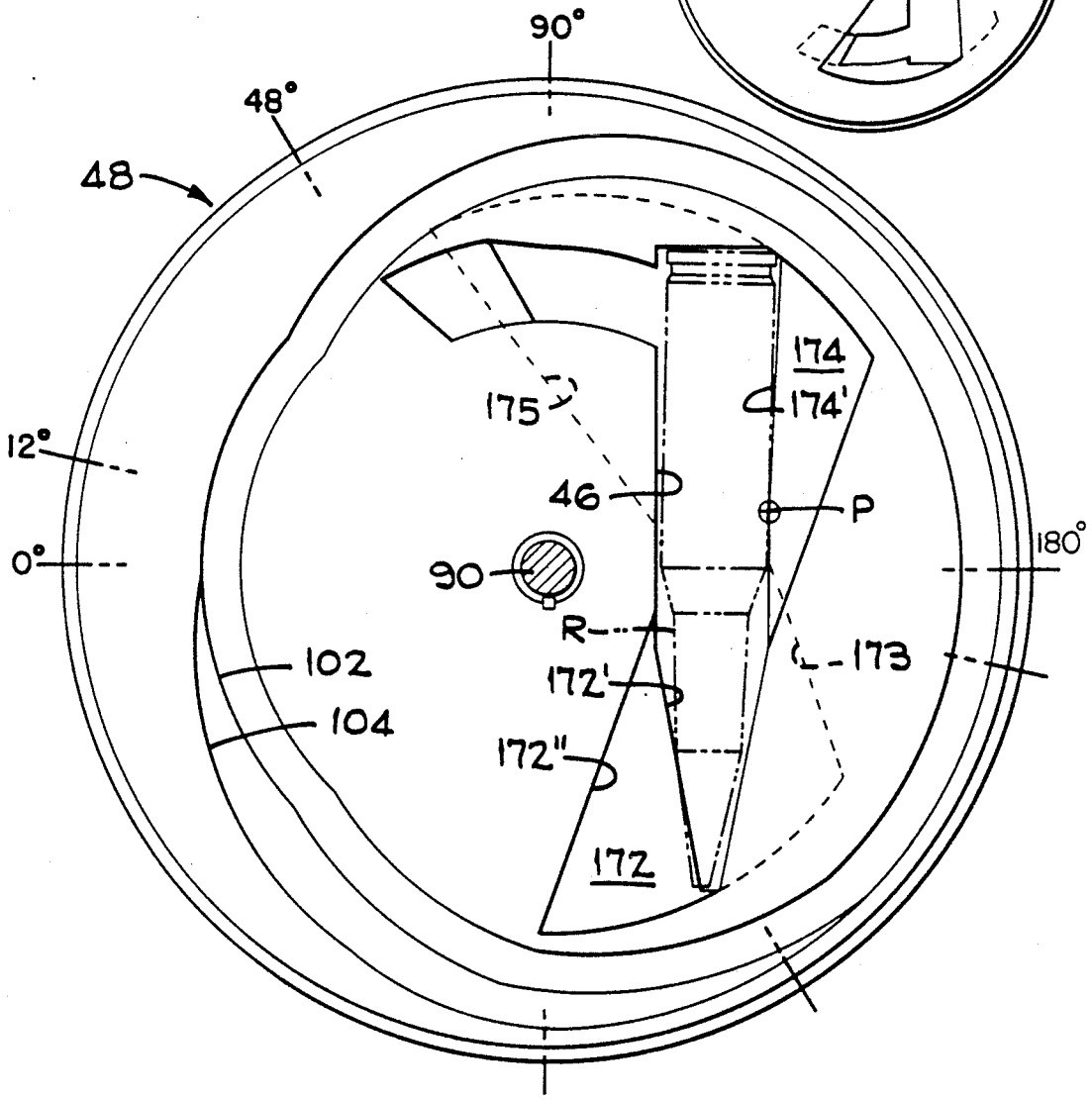
FIG. 5 is a top plan view of a circular round transfer disc illustrating a round therein, a contact pivot point, and two cam tracks.

FIG. 5 illustrates the top surface of the transfer disc 48 showing a continuous deep cam grooves 102 and a segment of a shallow cam groove 104. Having reference to FIG. 3, it will be noted that the cam follower 112 enters only the upper portion of the cam groove 102, thus permitting the follower 112 to pull out of the groove 102 and moves into a shallow portion of the cam groove 104 (FIG. 5) assisted by spring 115 and controls the round lifting finger 116. It will also be noted that cam follower 156 (FIG. 3) is positioned deeper in its cam groove 102 throughout its travel for controlling the movement of round lifter 144.

FIG. 5 also illustrates inclined round camming or lifting surfaces formed in the transfer disc 48 with the solid line portion 172 and 174 being upwardly inclined lifting surfaces, and the lower camming surface 173 and 175 being downwardly inclined guiding surfaces forming a continuation of the surface 172 and 174 respectively, but being below the upper surface of the transfer disc 48. The camming surfaces 172 and 173 have slightly rounded lower and upper edges to provide smooth pick-up and discharge of the rounds. Similarly, the case end of the rounds are cammed upwardly by an upwardly sloping camming surface 175 below the upper surface of the transfer disc 48 as illustrated in dotted lines, while a second camming surface 174, shown in full lines, communicates with the upper surface of the transfer disc 48 and has rounded leading and trailing edges to ensure smooth transfer of the rounds R or R'.

Figure 13:
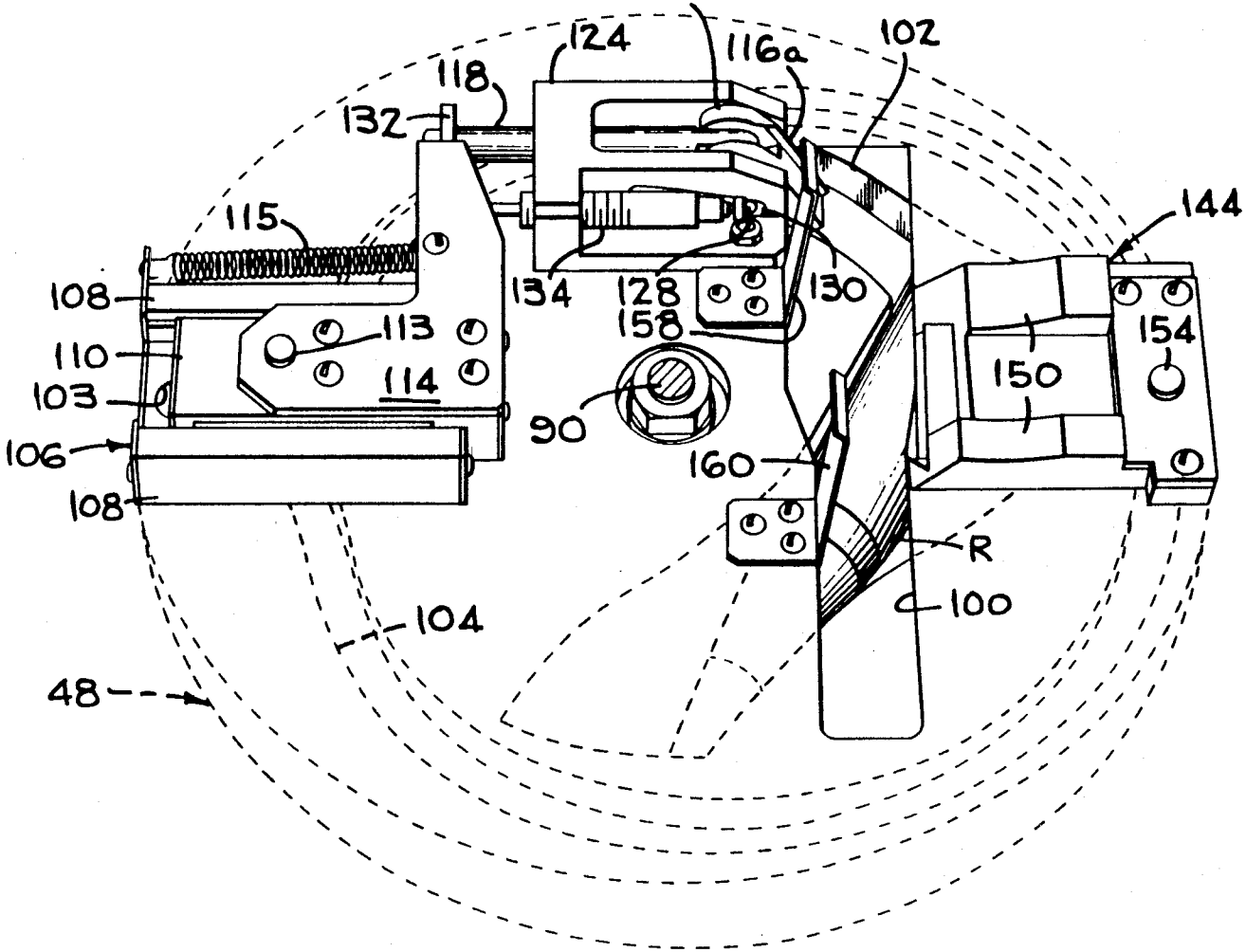

It will be appreciated that the rounds R cannot be cammed through the outlet opening 100 (FIG. 3) until the rounds are prevented from rotating within the transfer disc 48. After the rounds are moved through the tapered inlet opening 96 (FIG. 3) in the bottom wall 94, the rounds are continuously and progressively rotated in a counterclockwise direction through the positions shown in FIGS. 11, 12 and 13 during which time the rounds R and the slidable round lifter 144 move partially to the right (FIG. 12) away from the outlet opening 100 in the upper plate 98. Further rotation in a counterclockwise direction causes the cam groove 102 to begin pivoting the round lifter fingers 116 downwardly into the path of movement of the rounds R as illustrated in FIG. 13.

Figure 14:
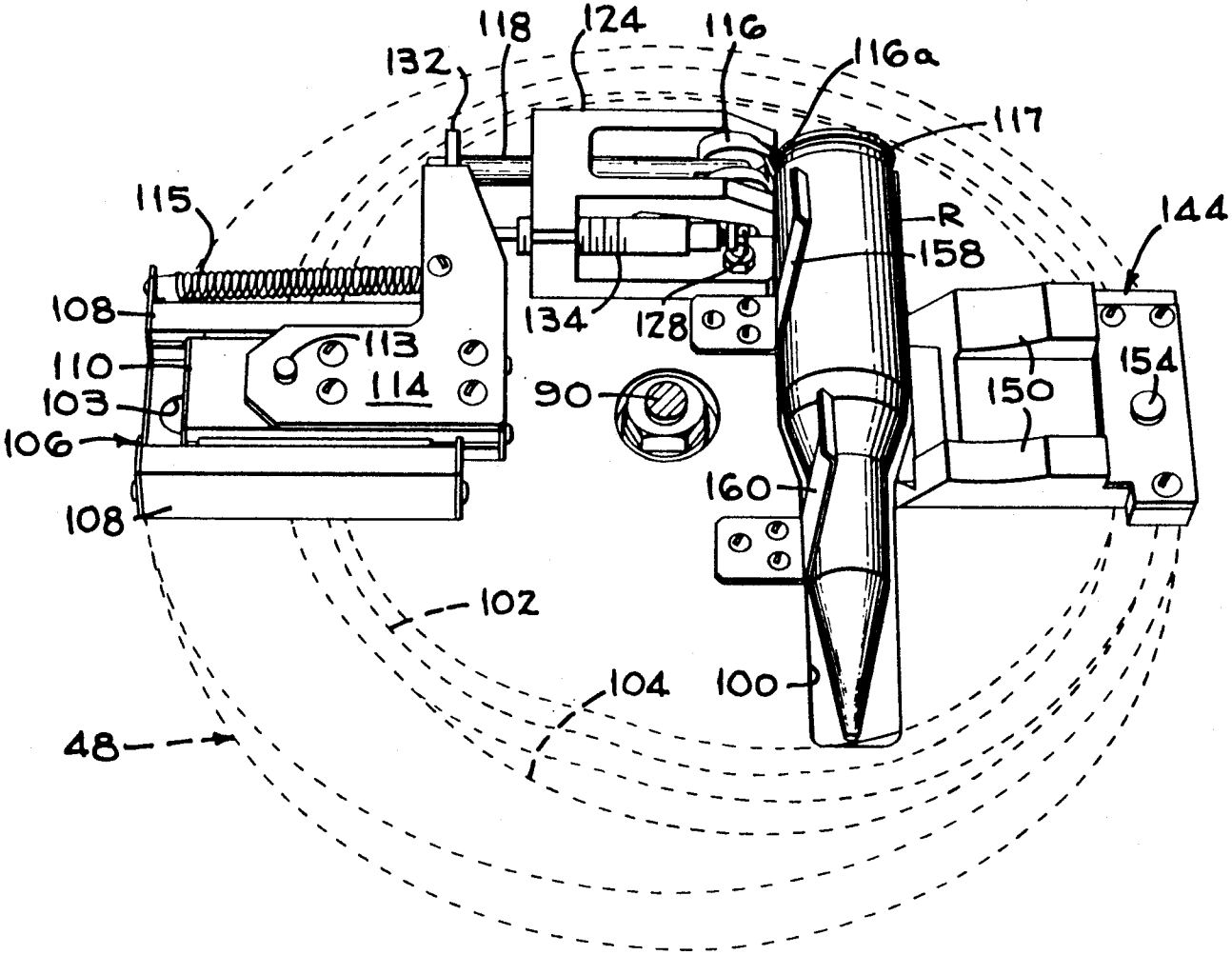

Continued rotation of the transfer disc 48 causes the round lifter fingers 116 to intercept and stop the rounds R from further rotation with the transfer disc 48 upon reaching a position in alignment with the outlet opening 100 as illustrated in FIGS. 4 and 14 through which the rounds R must pass when cammed out of the transfer disc 48 during which time the transfer disc continues to rotate at a selected speed up to about 400 rpm's.

Figure 7:
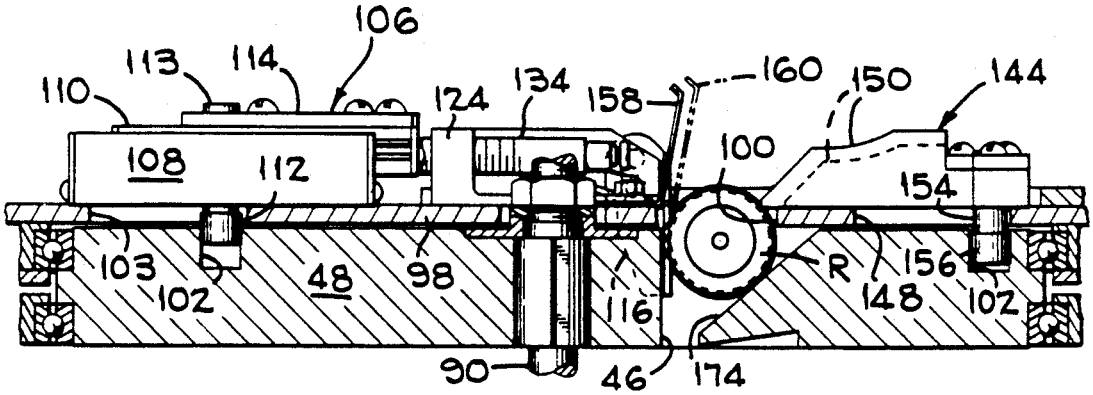
FIG. 7 is an operational section similar to FIG. 3 but illustrating the transfer disc rotated about 12° in a counterclockwise direction relative to FIG. 3, a lower stationary plate being omitted.
Figure 8:
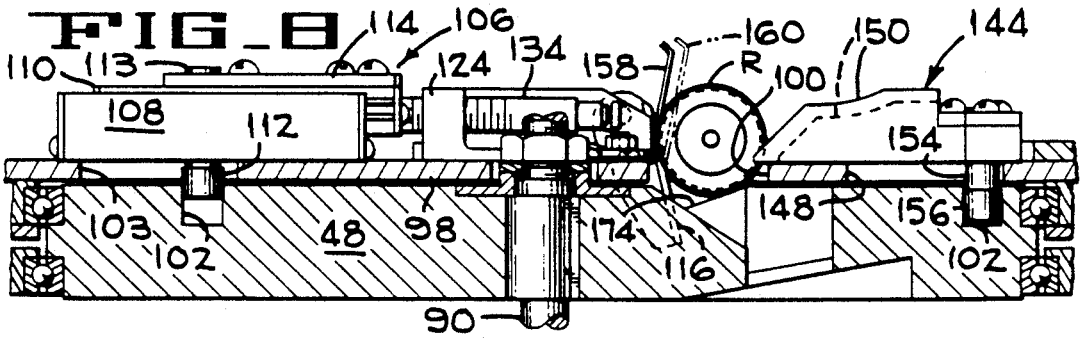
FIG. 8 is an operational view similar to FIG. 7 but illustrating the transfer disc rotated about 48° in a counterclockwise direction relative to FIG. 3.

More particularly, the lifter finger 116 engages each round in turn, and the V-shaped edge 116*a* enters the groove 117 in the rounds R to prevent the rounds from moving axially and prevent the rounds from rotating with the transfer disc 48. At this time, the rounds R contact a point P at approximately the center of the rounds R causing the projectile to be cammed up camming surface 172. The case and its projectile of the rounds then start up a camming surface 174 (FIG. 3) of the transfer disc 48 and continue up the camming surface as shown in FIG. 7. Further rotation of the transfer disc 48 lifts the rounds R substantially out of the transfer disc 48 as illustrated in FIGS. 8 and 14 while riding on the camming surfaces 172,174 (FIG. 7); and the slidable round lifter 144 remains retracted from the rounds R, while the cam track 102 (FIG. 2) causes the round lifter fingers 116 to urge the rounds upwardly.

Figure 9:
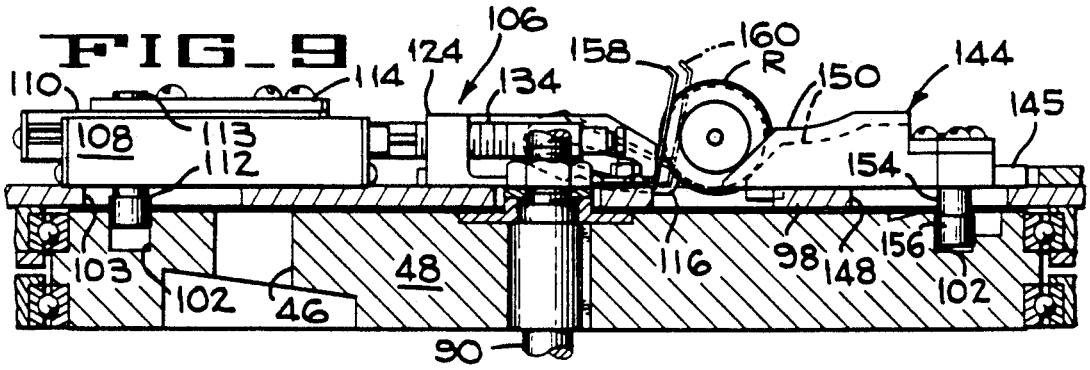
FIG. 9 is an operational view similar to FIG. 7 but illustrating the transfer disc rotated about 90° in a counterclockwise direction relative to FIG. 3.

FIG. 9 illustrates the rounds R as being lifted above the transfer disc 48 while partially supported by the lifter 144, the lifter finger 116, and the resilient round guides 158,160; and FIG. 10 illustrate the rounds R fully supported on the slidable round lifter 144 and retained in pick-off position by the resilient round guides 158.160 for transfer away from the round transfer unit 50 as will be described hereinafter.

It will be understood that as one round R is being cammed out the transfer disc 48 another round is ready to enter the transfer disc 48 and will be moved into the disc as illustrated in FIG. 19.

The previously described camming surfaces of the transfer disc 48 are somewhat difficult to visualize. Accordingly, FIGS. 15 and 15A have been provided to illustrate the camming surfaces of the top (FIG. 15) and bottom (FIG. 15A) of the transfer disc 48, respectively, in perspective.

Figure 15:
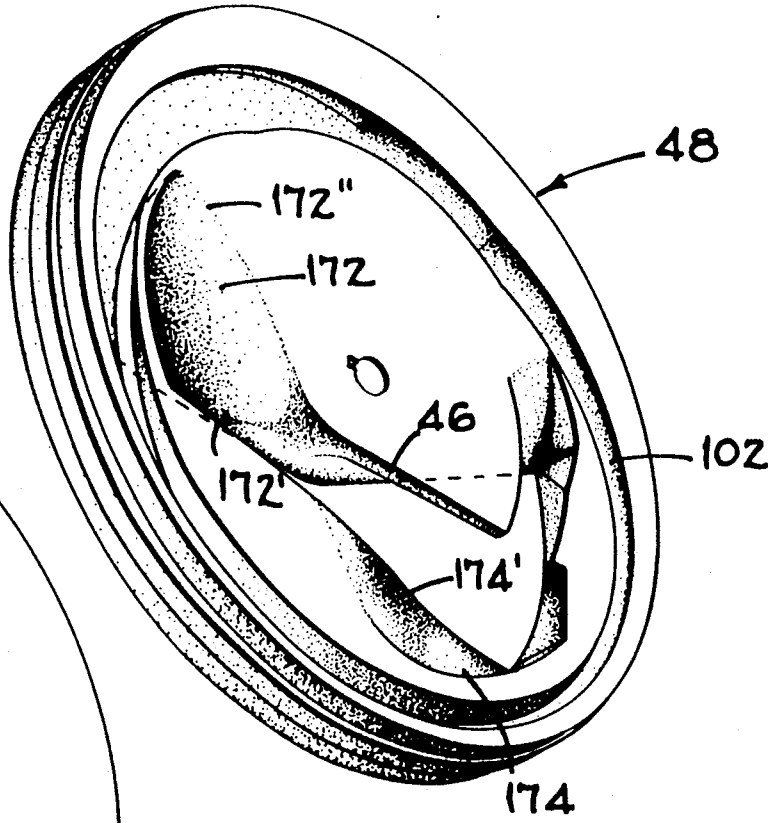
FIG. 15 is a perspective of the top surface of the transfer disc illustrating the camming surfaces for receiving and lifting the rounds.
Figure 15A:
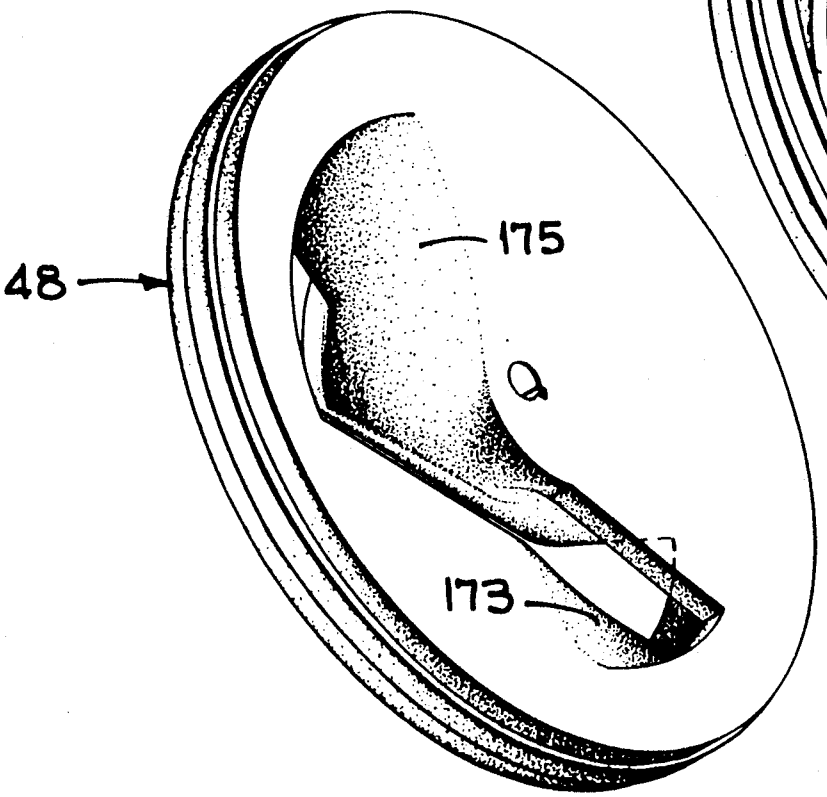
FIG. 15A is a perspective of the lower surface of the transfer disc rotated 180° relative to FIG. 15 illustrating the camming surfaces as seen from below for guiding the rounds upwardly.

As illustrated in the top view of FIG. 15, the camming surface 172 of the transfer disc 48, the small projectile end of rounds R or R' will first engage the lower edge 172' which lifts the small end of the rounds upwardly from a low edge to a high edge 172'' while rotating in a counterclockwise direction. Simultaneously, the case end of the rounds engage the lower edge 174' of a camming surface 174 and lifts the case and the rounds upwardly. Similarly, the bottom view of the disc 48 (FIG. 15A) includes camming surfaces 173 and 175. Thus, rotation of the camming surfaces in a counterclockwise direction (FIG. 5) progressively raises the rounds R (FIG. 3) vertically upward through the opening 100 in the upper plate 98 as illustrated in FIGS. 7–10. When the rounds R are cammed as above described, it has been determined that the initial contact at the pivot point P is located near the midpoint of the rounds R.

A dual round feeding system 180 is illustrated in FIGS. 16–27 for feeding different types of rounds R or R' of the same size into the above described ammunition transfer system 30 (FIGS. 1–15A).

Figure 16:
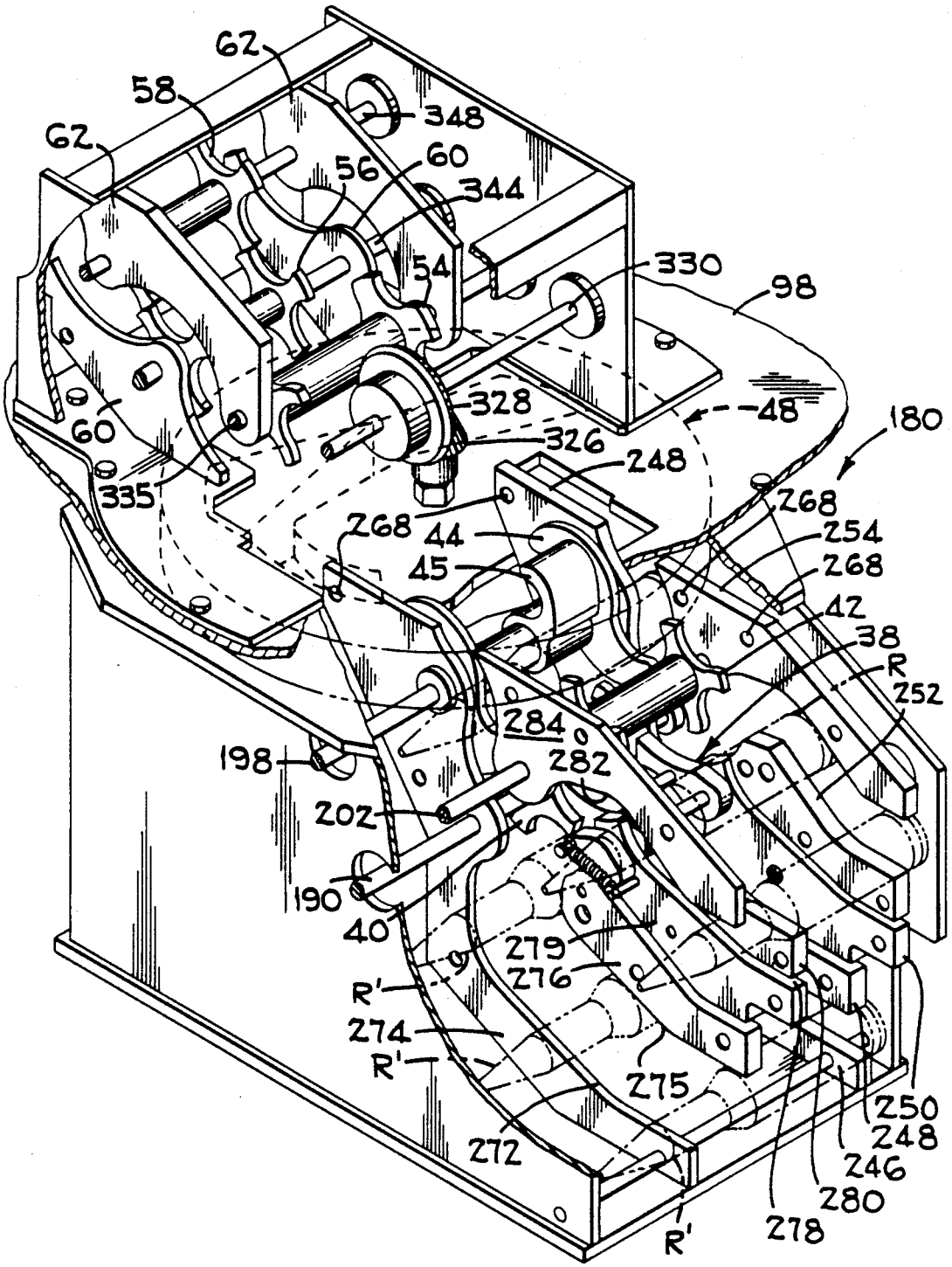
FIG. 16 is a perspective of the dual ammunition transfer mechanism with parts cut away and with other parts in phantom illustrating the main components of the dual ammunition transfer mechanism.
Figure 17:
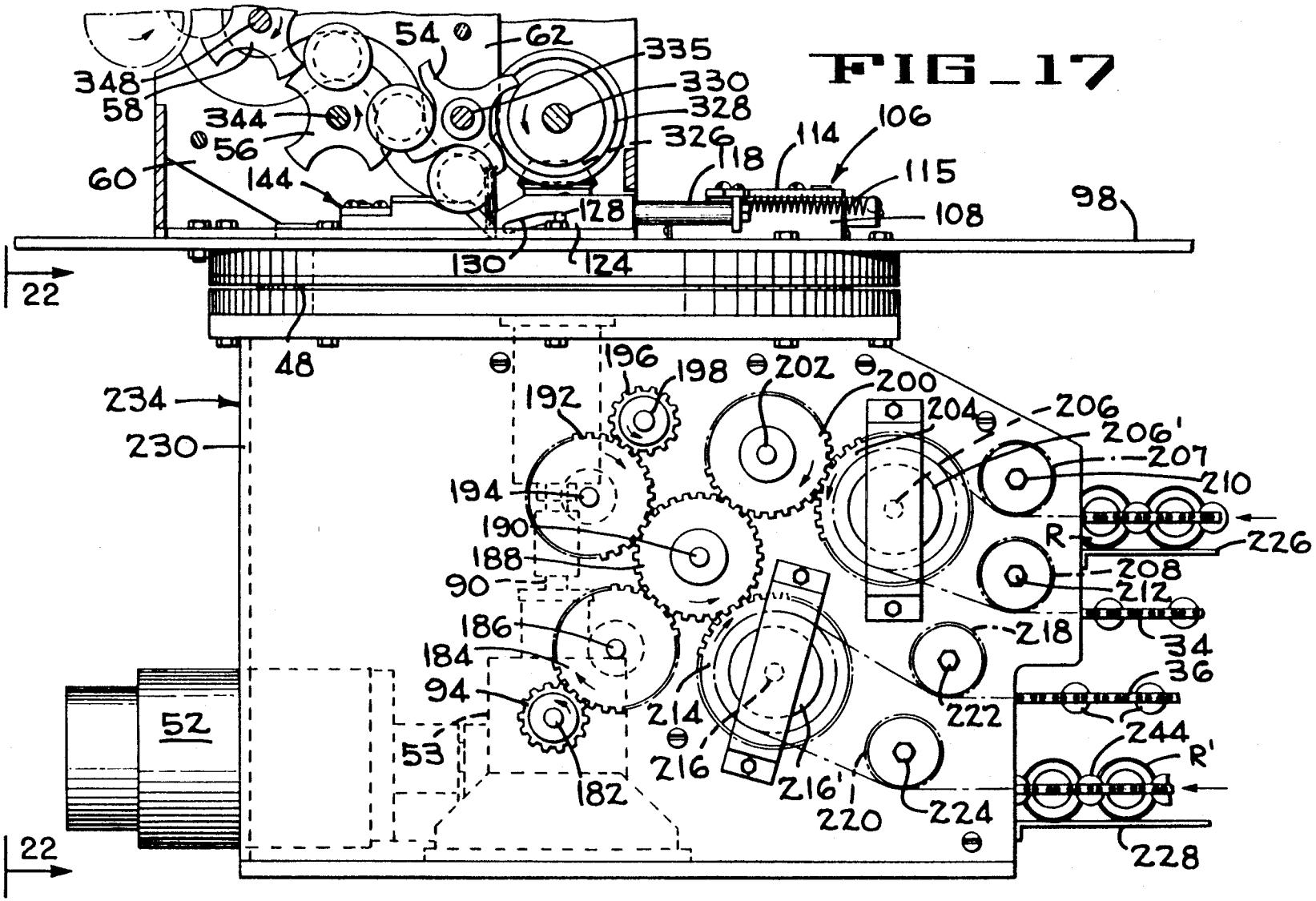
FIG. 17 is a side view of the dual ammunition transfer mechanism illustrating drive means for moving two rows of rounds of different types through the round transfer disc and thereafter guiding the selected rounds into a gun.

As best shown in FIGS. 16, 17 and 19, the apparatus for feeding rounds R and R' from the ammunition hopper 32 (FIG. 1) is powered by the drive motor 52 as best illustrated in FIGS. 17 and 19. The motor 52 directs power into a gear box 53 (FIGS. 1, 17 and 19) which drives the vertical shaft 90 and the transfer disc 48 (FIGS. 3, 17 and 19), and also drives a horizontal shaft 182 and the gear 94. The gear 94 (FIG. 17) drives idler gear 184 and is rotatable on a shaft 186 which meshes with a gear 188 keyed to a shaft 190. The gear 188 meshes with an idler gear 192 rotatable on a shaft 194. The gear 192 meshes with a gear 196 keyed to a shaft 198.

The gear 188 also meshes with an upper gear 200 keyed to a shaft 202 which meshes with a gear 204 connected to a shaft 206 through a clutch-brake 206' (FIG. 18) that drives the upper transfer conveyor 34 (FIGS. 1 and 17) and receives rounds R from the ammunition hopper 32. The chains 34,36 are urged downwardly by a pair of hold-down sprockets 207 and 208 journaled on shouldered capscrews 210 and 212. Also, the gear 188 (FIG. 17) meshes with a gear 214 connected to a shaft 216 through a clutch-brake 216' and is driven in a direction opposite to that of the gear 204 as indicated by the arrows when the clutch is engaged. Chain hold down sprockets 218 and 220 are journaled on shoulder capscrews 222 and 224 and maintain the lower conveyor 36 in the position illustrated in FIGS. 1 and 17.

Figure 18:
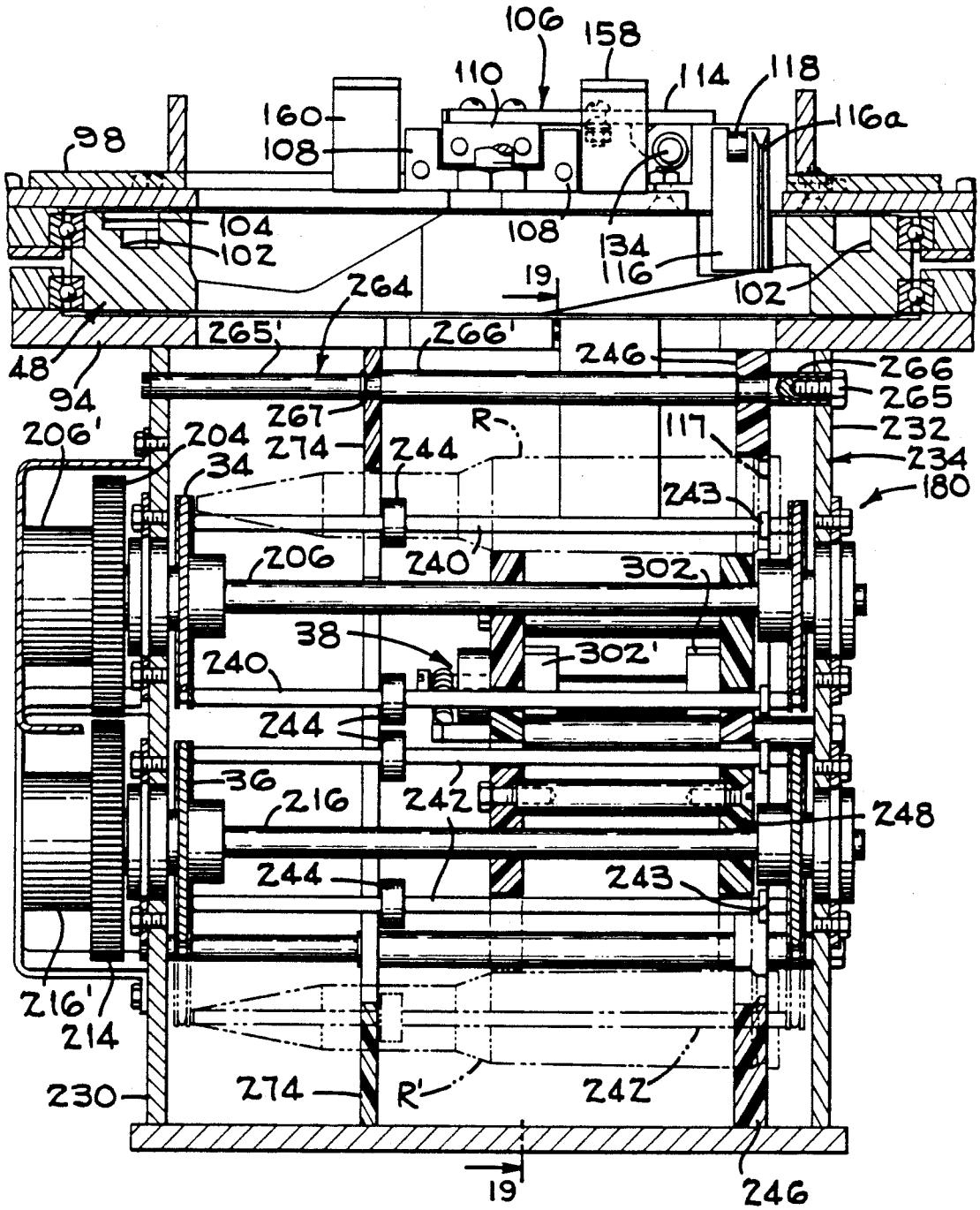
FIG. 18 is a vertical section taken along lines 18—18 of FIG. 19 illustrating the rounds and round guide members.

Having reference to FIGS. 17 and 18, it will be noted that the above described shafts are journalled in side walls 230, 232 of a housing 234, and it will be understood that one of the round feed conveyors 34 and 36 must be stopped while the other feed conveyor directs its ammunition rounds R toward the transfer disc 48. Accordingly, a conventionally electrical clutch-brake 206' (FIG. 18) is supported by the side wall 230 having a conventional clutch-brake mechanism (not shown) within the housing 206' which is coupled to the shaft 206. A second clutch-brake 216' is similarly connected between the wall 230 and the shaft 216. Thus, when it is desired to feed rounds R (FIG. 17) into the gun G, the clutch-brake within the housing 206' is engaged in response to the operator closing a switch (not shown), and its brake is released. If the operator wishes to feed rounds R' into the gun, the clutch in the clutch-brake housing 216' is engaged and the brake is released with the shaft 216 being stopped by the clutch-brake mechanism 216.

It will be noted that the rounds R in the upper transfer conveyor 34 (FIG. 1) are transferred from the ammunition hopper 32 to the dual round feeding system 180 with the upper rounds supported on a guide plate 226 (FIG. 17); while the rounds R' in the lower transfer conveyor 36 are transferred over a guide plate 228 from the ammunition hopper 32 (FIG. 1) by the lower run of a conveyor 36.

Figures 21, 25:
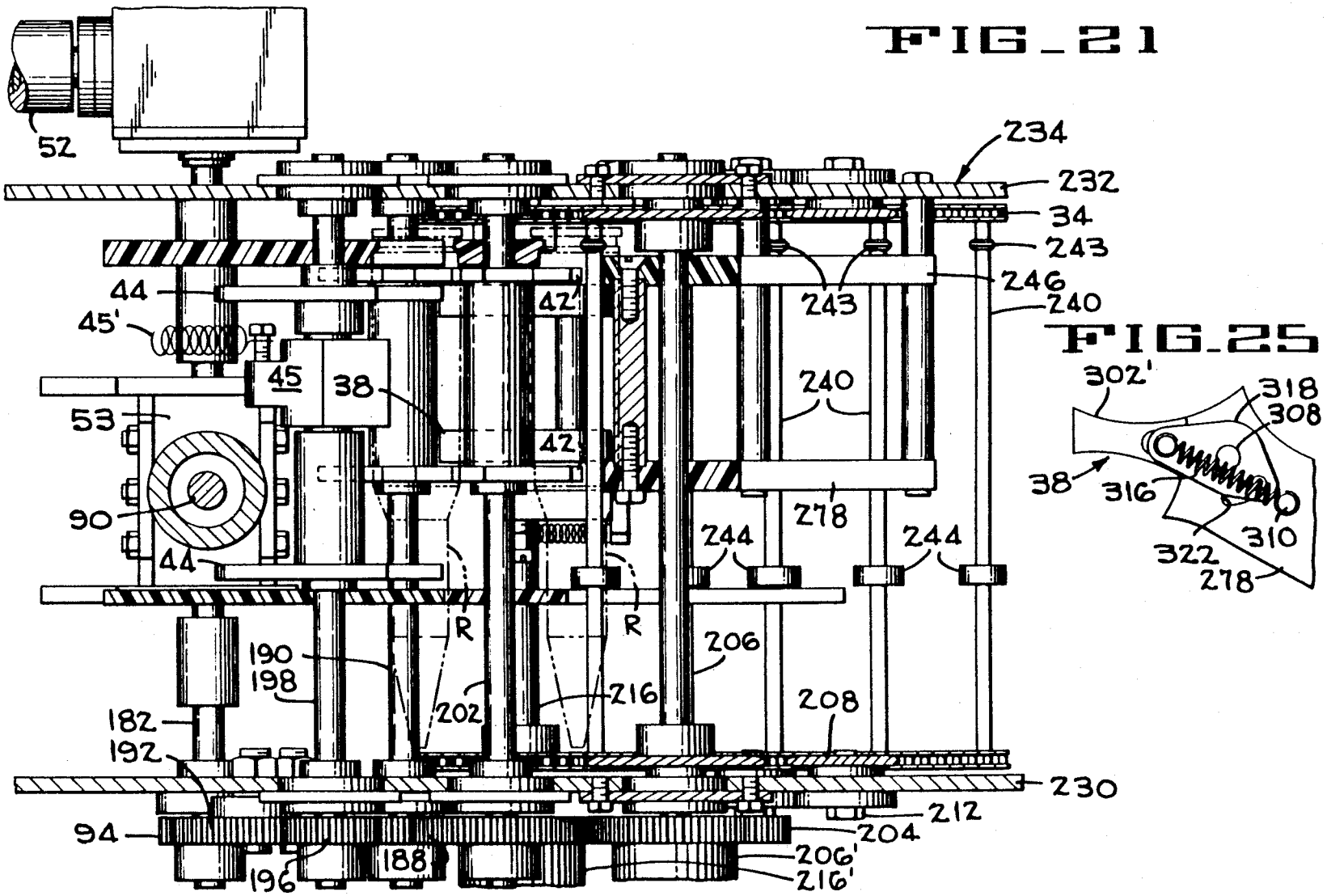
FIG. 21 is a horizontal section taken along lines 21—21 of FIG. 19 illustrating the gear drive for several shafts.
FIG. 25 is an operational view of the spring loaded transfer mechanism taken along lines 25—25 of FIG. 23.
Figure 22:
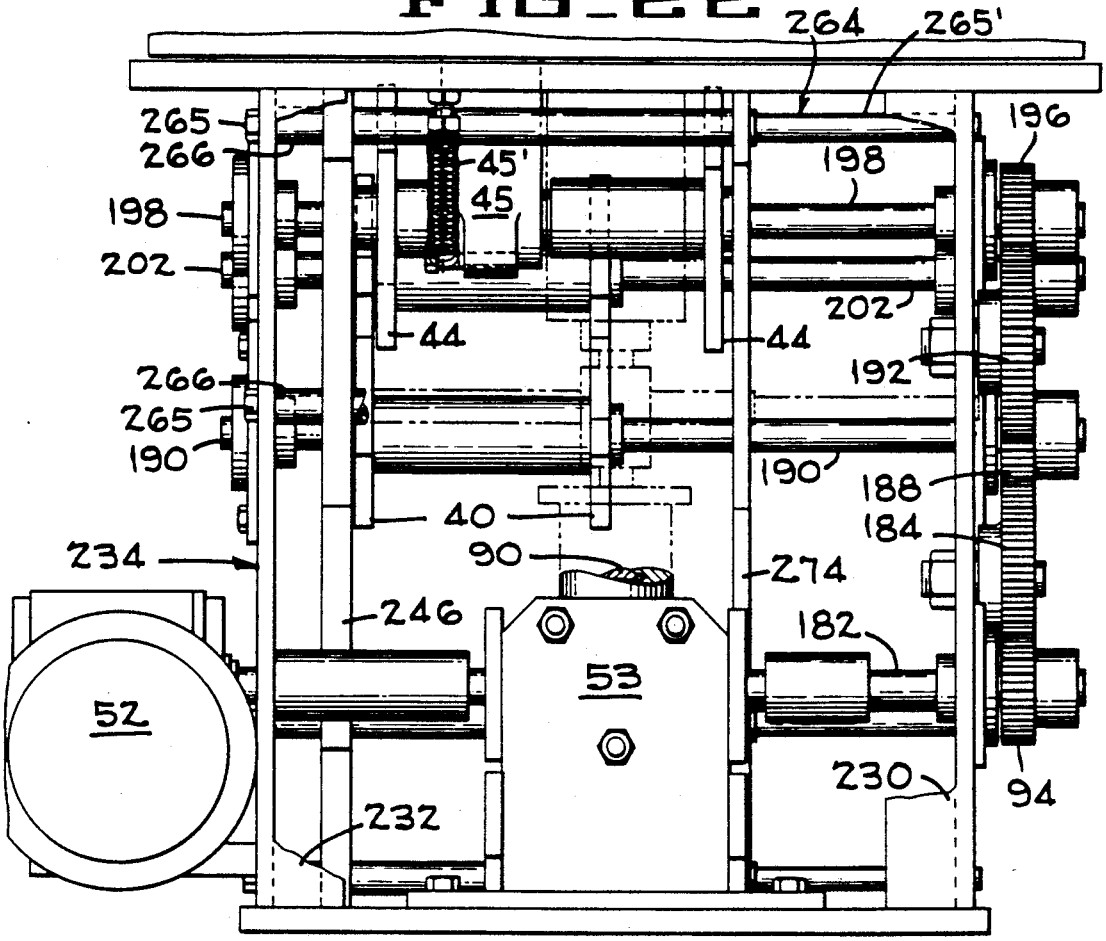
FIG. 22 is a vertical end view taken looking in the direction of lines 22—22 of FIG. 17 illustrating certain portions of the drive means of FIG. 17.

As best shown in FIGS. 18 and 21, a plurality of evenly spaced pusher bars 240 and 242 are supported by the chains of the conveyors 34 and 36, respectively, which guide and maintaining the rounds R and R' aligned while being conveyed. Each pusher bar 240 and 242 has a small rotatable disc 243 (FIGS. 18 and 21) thereon positioned to be received in the ejection groove 117 of the rounds R,R' to prevent axial movement of the associated rounds R,R'. Also, each pusher bar 240,242 has a larger wheel 244 thereon which engages a reduced diameter portion of the associated round R and R' thereby maintaining the axes of the rounds parallel while being conveyed by the conveyors 34 and 36.

FIGS. 16, 18, 19, 21 and 22, illustrate a plurality of guide tracks for guiding the rounds R in the upper conveyor 34 through the dual round feeding system 180. Similarly the lower rounds R are conveyed by the lower conveyor 36 with the cases of the rounds R' being guided by the upper surface of a lower one piece guide track 246 (FIGS. 16, 18 and 19) which guide track extends from the bottom of the round feeding system 180 to the top of the system as best illustrated in FIGS. 18 and 19. The case of the rounds R' are conveyed by the lower conveyor 36 and are guided by the upper surface of the one piece lower guide track 246, and a lower surface of a short second guide track 248 (FIG. 19). An upper surface of the guide track 248 is spaced from the lower surface of a third guide track 250 (FIGS. 16 and 19) a sufficient distance to allow the upper run of the lower conveyor 36 to be guided therethrough.

As best shown in FIGS. 16 and 18, the small diameter portions of the rounds R' in the lower conveyor 36 are guided upwardly toward the transfer disc 48 by an upper surface 272 (FIG. 16) of the lower sinuous guide plate 274, and by a lower surface 275 of an upper guide plate 276. An upper surface 278 of a guide plate 279 cooperates with a lower surface 282 of an upper guide plate 284 for guiding the small diameter portion of the rounds R into the star wheels 40 and 42, conveyed by the upper conveyor 34 (FIG. 19) for subsequent conveyance into the transfer disc 48.

Similarly, the upper surfaces of guide track 250 and upper guide track 252 are contoured to guide the lower run of the conveyor 34 therebetween. The right guide tracks 246, 248, 250, 252 and 254; and the left guide tracks 274, 276, 278, 280 and 284 are rigidly secured to side walls 230, 232 of the housing 234 (FIG. 16–22, 26 and 27) of the dual round feed system by a plurality of connectors 264 and sleeves 266 as best shown in FIGS. 18 and 19. FIG. 18 illustrates one of the connectors 264 and sleeves 266 at an upper portion of the housing 234. More specifically, FIG. 18 illustrates two of a plurality of connectors 264 each of which includes a short cap screw 265 that is screwed into an elongated threaded rod 265' having a screw driver slot in its outer end. A short sleeve 266 is received on the threaded end of the rod between the housing side wall 232 and the guide L bar 246. Similarly, a long sleeve 266' is mounted on the rod and is disposed between the guide bars 246 and 274 with a retaining ring 267 fitted in a groove (not shown) in the rod 265' thereby maintaining the guide bars 246 and 274 at the desired spacing FIG. 19 illustrates the location of the connectors and sleeves and similar to that described above but of different lengths, while FIG. 16 illustrates a plurality of holes 268 for accepting the connectors 264.

FIGS. 16, 18, 19, and 21–25 illustrate a pivotal round deflecting mechanism 38 for selectively transferring rounds from the upper conveyor 34 or from the lower conveyor 36 into the transfer disc 48. The two conveyors may handle the same type of rounds R, R' or different types of rounds.

Figure 23:
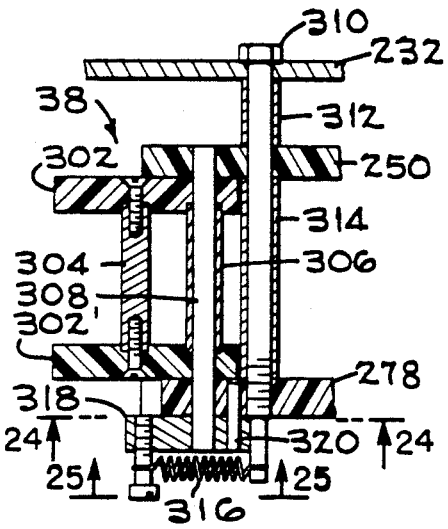
FIG. 23 is a section taken along lines 23—23 of FIG. 19 illustrating a round transfer mechanism for selectively deflecting rounds out of two round feed conveyors.
Figure 24:
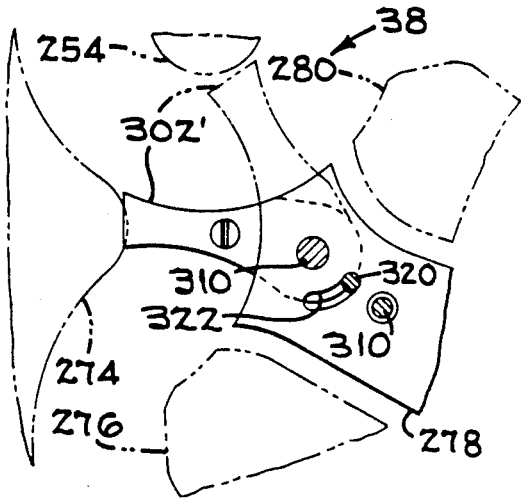
FIG. 24 is an operational view of the spring loaded transfer mechanism of FIG. 23 taken along lines 24—24 of FIG. 23.
Figure 26:
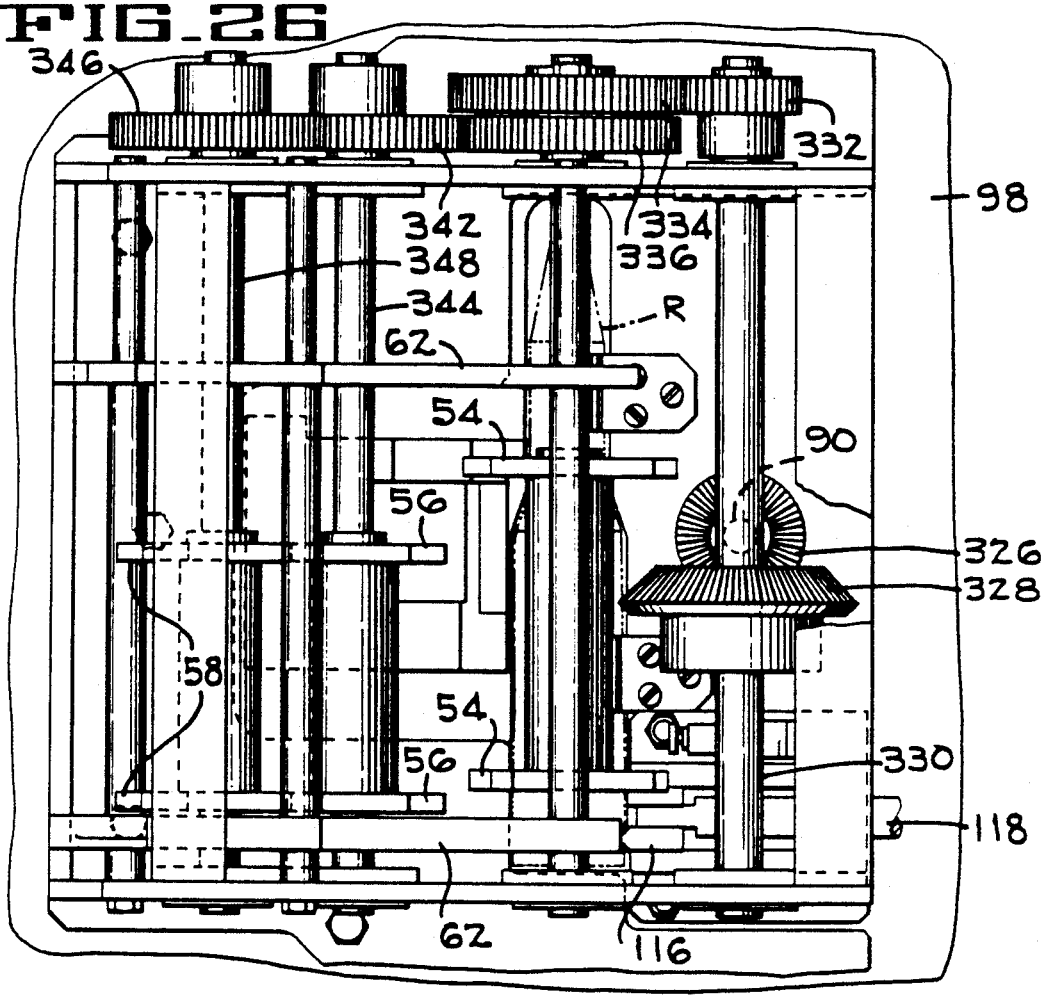
FIG. 26 is a plan view rotated 180° relative to FIG. 19 illustrating the round controlling components for accepting the rounds from the round transfer mechanism.
Figure 27:
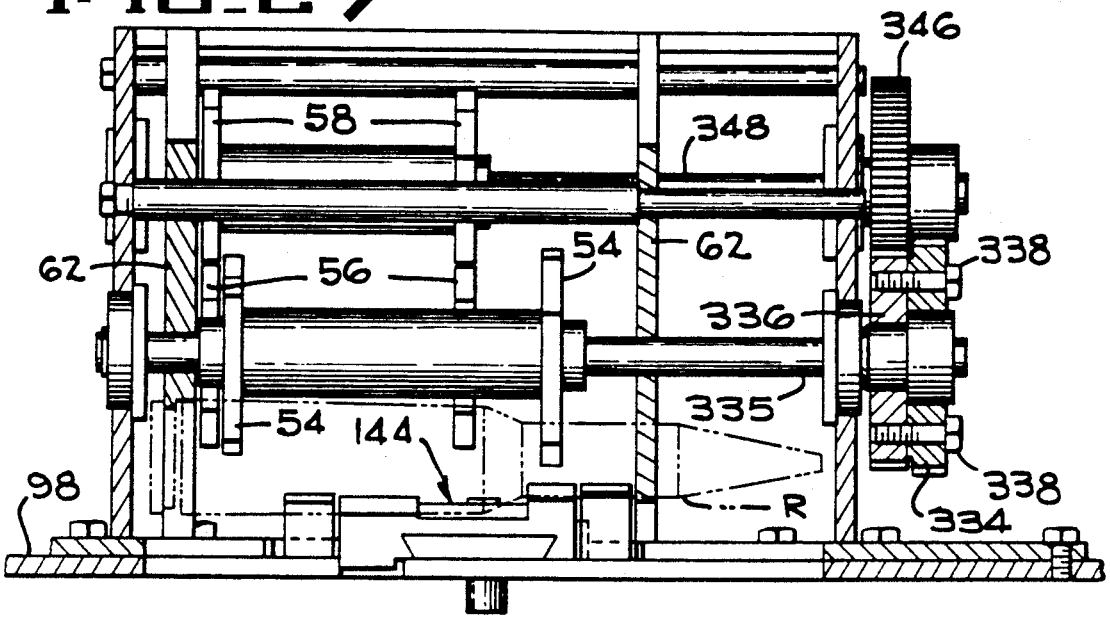
FIG. 27 is a section taken along lines 27—27 of FIG. 20 illustrating the position of star wheels and guide bars for guiding rounds after moving upwardly out of said round transfer mechanism.

The round deflecting mechanism 38 includes a pair of round engaging pivot arms 302,302' (FIGS. 18, 23 and 24) connected together by fasteners and a bar 304 and a sleeve 306 which are pivotally supported on round guide tracks 250 and 278. As illustrated in FIG. 23 an elongated bolt 310 and spacers 312 and 314 maintain the members 232, 250 and 278 spaced a desired distance from each other. A small diameter extension of the bolt 310 provides an anchor for a spring 316. The other end of the spring is connected to a lever arm 318 that is rigidly connected to the rod 308 and has a cam pin 320 secured thereto and slidably received in an arcuate slot 322 in the arm 278 (FIG. 24). FIG. 25 illustrates that the spring 316 maintains the pivot arms in one of two of their selected positions since the spring 316 moves overcenter of the axis of the rod 308.

When both conveyors 34 and 36 are full of rounds R as shown in FIG. 17, only one conveyor will be selected to direct rounds R or R' through the dual round feed system 180. When it is desired to feed rounds R through the transfer disc 48 and gun G (FIG. 1), the lower conveyor 36 is stopped and the upper conveyor 34 moves rounds R against and over the pivot arms 302 and 302' (FIGS. 23, 24 and 25) which moves the arms from the phantom line position (FIG. 24) to the solid line position. If it is desired to fire different types of rounds R' in the lower conveyor 36, the operator operates controls (not shown) which stops the upper conveyor 34 and starts the lower conveyor 36 which causes the lower rounds therein to engage and pivot the pivot arms 302,302' to the phantom line position as illustrated in FIG. 24 thereby directing the rounds R' through the system to the gun G (FIG. 1).

After passing each round R or R' (FIG. 19) through the round deflecting mechanism 38 (FIG. 19), the star wheel 40 or 42, the round is engaged by a Z-shaped feeder 44. The Z-shaped feeder 44 is rigidly secured to the shaft 198 and moves the round partially into the tapered inlet opening 96. The kicker 45 is journalled on the shaft 198 and is urged by an overcenter spring 45' to move in a clockwise direction against the rounds. The kicker 45 is contoured to apply pressure against the round and thereafter urges the round into the slot 46 in the transfer disc 48 as illustrated in FIG. 19.

As best shown in FIGS. 16, 19, and 21, the spaced pair of Z-shaped feeders 44 are secured to the shaft 198 and are driven in the direction of the arrows in FIG. 19. Similarly, the upper pair of round engaging star wheels 42 and the lower pair of star wheels 40 are driven in the direction of the arrows in FIG. 19 and move the rounds R or R' upwardly from the associated conveyors 34 or 36 (FIG. 1) depending upon the position of the pivot arms of the star wheel assembly 38 as illustrated in FIG.

24. After passing between the star wheels 40 and 42, the upper Z-shaped feeder wheels 44 cooperates with upper guiding surfaces of the guide plates 274, 284 and 246,254 (FIG. 16) to guide the rounds. As best illustrated in FIG. 19, the relatively wide round kicker 45 which is journaled on the shaft 198 and is urged into the path of movement of the rounds R or R' as they move upwardly and enter the slot 96 in the bottom plate 94 and into the transfer disc 48. The spring actuating round kicker 45 (FIGS. 19, 21 and 22) bears against the rounds R or R' and assists in moving the rounds upwardly into the transfer disc 48 (FIG. 19); and upon moving into the inlet opening 96 (FIG. 3) in the bottom plate 94 of the transfer unit 180, the round kicker moves the rounds through the slot 46 into the transfer disc 48 as illustrated in FIG. 19.

After the rounds are discharged from the transfer disc 48 as previously described, they are moved upwardly between the pairs guide tracks 60, 62 (FIGS. 17 and 19) into position to be engaged by the previously described pairs of star wheels 54, 56 and 58. Thereafter, the rounds are conveyed by the flexible conveyor 66 (FIG. 1) into the accumulator magazine 64 for movement by the conveyor 70 into the gun G.

FIGS. 19, 20, 26 and 27 illustrate the drive system for the pairs of star wheels 54, 56 and 58 (FIG. 19). The vertical shaft 90 (FIGS. 19 and 26) receive power from the motor 52 (FIG. 19) and drives a bevel gear 326 which meshes with a bevel gear 328 keyed to a shaft 330. The shaft 330 (FIG. 26) has a gear 332 (FIG. 20) secured thereto which meshes with an adjustable timing gear 334 that is adjustably secured to a gear 336 which is keyed to a shaft 335.

Bevel gears 326 and 328 will self-adjust to maintain pick-up timing between the lifting mechanism 50 and pick-up mechanism 48 and star wheels 54,56 and 58 because they are supported on the common rotatable plate 98. In order to accurately time the pairs of star wheels 54, 56 and 58 (FIG. 19) with the lifting mechanism 50, pairs of cap screws 338 (FIG. 20) are received in slots 340 in the gear 334 and are screwed into threaded holes (not shown) in the gear 336 thus providing the desired timing. The gears 336 meshes with a gear 342 secured to a shaft 344 that meshes with a gear 346 keyed to a shaft 348. Thus, power from the shaft 330 drives the star wheels 54, 56 and 58 in the directions indicated in FIG. 19, and in timed relationship relative to the rotation of the transfer disc 48 for transferring the round R or R' into the conventional flexible conveyor 66 (FIG. 1) which feeds the rounds R and R' into the accumulator magazine 64 as diagrammatically illustrated in FIG. 1.

In operation of the method and apparatus of the present invention, two types of ammunition rounds R and R' (FIG. 1) are preferably loaded into the ammunition hopper 32. The rounds R,R' may be armor piercing or high explosive, and are preferably from about 50 caliber to at least 35 millimeters with the rounds R being loaded from the hopper 32 into the upper conveyor 34, and the rounds R' being transferred into the lower conveyor 36. It will, of course, be understood that the ammunition loader may be made to handle larger or smaller rounds. The firing rate of the gun G is about 500 rounds per minute. However, it will be understood that the firing of the gun is not continuous since targets are not always available, and when available may not be in sight of the gunner. Thus, the ammunition hopper 32 and the accumulator magazine 64 receive ammunition rounds continuously until full, and when the gun is being fired, the gun removes the ammunition from the accumulator magazine 64.

With the ammunition hopper 32 loaded or partially loaded, the operator closes a conventional switch which will direct selected rounds R or R', one at a time, into the slot 46 in the transfer disc 48 which is continuously rotating at a selective rate up to about 400 rounds per minute, and thereafter into the star wheels 54, 56 and 58 and through the flexible conveyor 66 into and through the accumulator magazine 64 to the gun which fires the rounds. If the gunner has been firing rounds R from conveyor 34, and wishes to fire rounds R', he merely actuates a conventional switch (not shown) which actuates the brake of the clutch-brake 206'(FIG. 18) thereby stopping the transfer conveyor 34; and simultaneously actuates the clutch of the clutch-brake 216' which starts transfer conveyor 36. The rounds R' from conveyor 36 will push the pivot arms 302, 302' (FIG. 23) upwardly as shown in phantom lines in FIG. 24. When the rounds R are being conveyed by conveyor 34, the pivot arms 302, 302' will be positioned in the solid line position in FIG. 24.

From the foregoing description it will be apparent that the dual ammunition transfer mechanism of the present invention may be mounted on a tracked military vehicle as illustrated in FIG. 1, or may be mounted on other stationary or movable military equipment. The dual ammunition transfer mechanism is adapted to direct rounds into a gun at a rate up to 400 rounds per minute. The rotatable transfer disc 48 maintains the axis of the rounds in a predetermined plane, illustrated as a horizontal plane herein, by employing camming surfaces within the transfer disc.

Although the best mode contemplated for carrying out the present invention has been herein shown and described, it will be understood that modification and variation may be made without departing from what is regarded to be the subject matter of the invention.

What is claimed is:

1. An ammunition round transfer mechanism comprising:

means for conveying rounds along a path;

means defining a rotatable transfer disc having a round receiving slot and camming surfaces therein for receiving rounds from said path; and round lifting means movable between a position within said slot to a position out of said slot for engaging each round in turn for terminating rotation of the round in the slot and cooperating with said camming surfaces for lifting each round in turn out of said slot.

2. An ammunition transfer mechanism according to claim 1 and additionally comprising means for feeding another round into said slot while a round is being lifted out of said round receiving slot.

3. An apparatus according to claim 1 and additionally comprising means defining a first cam groove in said rotatable transfer disc, and means operatively connected between said first cam groove and said round lifting means for moving said round lifting means between a position parallel to an axis of rotation of said rotatable transfer disc and a position out of said round receiving slot.

4. An apparatus according to claim 3 and additionally comprising a slidable round lifter movable between a position away from said round receiving slot and a position closing said round receiving slot for assisting said round lifting means to support the round above said rotatable transfer disc.

5. An apparatus according to claim 4 and additionally comprising a pivotable upper plate disposed above said transfer disc with a round receiving opening therein and slidably supporting said slidable round lifting means.

6. An apparatus according to claim 5 wherein said pivotable upper plate slidably and pivotably supports said round lifting means.

7. An apparatus according to claim 6 wherein said round lifting mechanism additionally comprises a V-shaped edge for entering a groove in the round for preventing axial movement of the round when being cammed out of said slot in said transfer disc.

8. An apparatus according to claim 5 and additionally comprising a spaced pair of resilient round guides secured to and projecting above said pivotable upper plate and cooperating with said slidable round lifter for stabilizing each round after moving above said stationary upper plate.

9. An apparatus according to claim 1 wherein said ammunition transfer disc is capable of receiving and discharging rounds at the rate of up to 400 rounds per minute for supplying rounds to a gun having a firing rate of about 500 rounds per minute.

10. An apparatus according to claim 5 and additionally comprising a cam pin secured to and projecting out of said round lifting means, and a cam slot in a wall supported on said pivotable upper plate for camming said round lifting means between a position above said transfer disc and a round stopping and lifting position within said slot in said rotatable transfer disc.

11. An apparatus according to claim 10 and additionally comprising a shock absorber adjustably secured to said pivotable plate and adapted to reduce impact as said round lifting means stops rotation of a round within said round receiving slot of said rotatable transfer disc.

12. An apparatus according to claim 1 wherein said ammunition rounds are 12.7 to 35 millimeter rounds.

13. A dual ammunition transfer mechanism comprising:

first conveyor means for conveying first rounds along one path;

second conveyor means for conveying second round of a different type along another path;

round selector means for selecting rounds from only one of said paths while terminating movement of the rounds in the other path;

means defining a rotatable transfer disc having a round receiving slot with camming surfaces therein for receiving said selected rounds only from said one selected path;

round lifting means movable into position to engage each round when in said round receiving slot for terminating rotation of said selected rounds and cooperating with said camming surfaces for lifting said rounds out of said slot; and conveying means for conveying said selected rounds into a pivotal gun.

14. An apparatus according to claim 13 wherein said first and second conveyors are endless conveyors;

guide means for each of said conveyor for guiding said first and second rounds along separate circuitous paths;

operator controlled power means connected to said first and second conveyor means for selectively driving said first and second conveyor means;

means defining a pair of star wheels driven in opposite directions for selectively accepting rounds from said driven one of said first and second conveyor means;

means defining a Z-shaped feeder for accepting rounds from said driven one of said first and second conveying means; and spring activated kicker means for kicking each selected round in turn into said round receiving slot.

15. An apparatus according to claim 14 wherein rounds from said selectively driven conveyor actuates said round selector to accept the rounds from said selected driven conveyor.

16. An apparatus according to claim 15 wherein said round selector includes spaced pivot arms which are pivoted into a selected round guiding position by rounds from said selected driven conveyor.

17. An apparatus according to claim 16 wherein said pivot arms are maintained in said selected round guiding position by an overcenter spring.

18. An apparatus according to claim 16 wherein said pivot arms are transferred from a previously selected round guiding position to a position guiding rounds from the other one of said first and second conveyors by driving said other one of said first and second conveyors.

19. An apparatus according to claim 13 wherein said first and second conveyor means are driven at a rate up to 400 rounds per minute.

20. An apparatus according to claim 13 and additionally comprising a pivotable upper plate disposed above said transfer disc with a round receiving opening therein and slidably supporting said round lifting means, said pivotable upper plate pivoting with said pivotal gun and capable of transfer round to said gun when in a plurality of pivotal positions.

21. An ammunition round transfer mechanism, comprising:

means for conveying rounds along a path;

means defining a driven rotatable transfer disc rotatable about an axis and having a round receiving slot and camming surfaces therein for receiving rounds from said path;

means defining an upper mounting plate pivotable about said axis and having an outlet opening therein;

means defining a round lifting mechanism slidably received on said upper mounting plate for partially supporting a round when moved out of said outlet opening;

means defining a continuous annular deep cam groove in said rotatable transfer disc;

means defining a shallow segment of a second cam groove communicating with said deep cam groove in said rotatable transfer disc;

a first cam follower operatively connected to said round lifting mechanism and deeply received in said deep cam groove for moving said round lifter between a retracted position and a round supporting position;

a second cam follower operatively connected to said round lifting means and projecting a short distance into said deep cam groove and into said shallow second cam groove; and resilient means connected between said pivotable upper mounting plate and said round lifting mechanism cooperating with said shallow segment of said second cam groove for lifting each round in turn out of said slot.

22. An apparatus according to claim 21 and additionally comprising;

a non-rotatable bottom plate positioned below said transfer disc and having an inlet opening therein;

round kicker means for feeding the rounds one at a time through said inlet opening in said non-rotatable bottom into said round receiving slot plate in said disc;

conveying means supported by said upper mounting plate for pivotal movement about said axis; and means supporting a gun for pivotal movement about said axis; and second power means for driving said gun and a gun transfer unit.

23. An apparatus according to claim 22 and additionally comprising:

round conveying means supported on and above said rotatable upper mounting plate;

means defining a tub-shaped turret basket supported for pivotal movement about said axis and having a lower wall connected to and rotatable with said rotatable upper plate;

an accumulator magazine mounted on said lower wall for rotation about said axis; and second drive means for driving said turret relative to said pivotal upper mounting plate.

24. A method of transferring ammunition rounds between feed means and a gun, comprising the steps of;

conveying the rounds into an input opening of a round receiving slot in a rotating round transfer disc having camming surfaces therein for camming the round through an output opening of said round receiving slot; and moving a round lifter finger into said slot to intercept and stop rotation of said round while said round transfer disc continues to rotate and cams said round through said output opening while receiving another round in said slot.

25. A method according to claim 24 and additionally comprising the steps of moving a plurality of rounds through said round receiving slot into a gun.

26. A method according to claim 24 and additionally comprising the steps of independently driving first and second conveying means with said first conveying means supporting and conveying a first type of rounds to a transfer position toward said inlet opening, and with said second conveying means supporting and conveying a second type of rounds to said transfer position toward said inlet opening, and stopping said first conveyor for enabling the second conveyor to move said second type of rounds into said transfer disc and stopping said second conveyor for enabling the first conveyor to move said first type of rounds into said transfer disc.

27. A method according to claim 26 and additionally comprising the step of receiving the selected rounds and conveying the selected rounds closely adjacent to said inlet opening, and kicking the selected round one at a time into said input opening.

28. A method according to claim 27 wherein said rounds are fed into said input opening at a rate up to 400 rounds per minute.

* * * * *